US007079623B2

(12) United States Patent
Heuft et al.

(10) Patent No.: US 7,079,623 B2
(45) Date of Patent: Jul. 18, 2006

(54) X-RAY UNIT FOR THE GENERATION OF BRIEF X-RAY PULSES AND INSPECTION DEVICE OPERATING WITH SUCH AN X-RAY UNIT

(75) Inventors: Bernhard Heuft, Burgbrohl (DE); Wolfgang Polster, Andernach (DE)

(73) Assignee: Heuft Systemtechnik GmbH, Burgbrohl (DE)

( * ) Notice: Subject to any disclaimer, the term of this patent is extended or adjusted under 35 U.S.C. 154(b) by 0 days.

(21) Appl. No.: 10/535,757

(22) PCT Filed: Nov. 21, 2003

(86) PCT No.: PCT/EP03/13082

§ 371 (c)(1),
(2), (4) Date: May 20, 2005

(87) PCT Pub. No.: WO2004/047504

PCT Pub. Date: Jun. 3, 2004

(65) Prior Publication Data

US 2006/0013363 A1 Jan. 19, 2006

(30) Foreign Application Priority Data

Nov. 21, 2002 (DE) ..... 202 18 138

(51) Int. Cl.
*H05G 1/32* (2006.01)

(52) U.S. Cl. ..... 378/111; 378/119

(58) Field of Classification Search ..... 378/101, 378/105, 106, 111, 112, 113, 119, 121; 250/370.08, 250/370.09

See application file for complete search history.

(56) References Cited

U.S. PATENT DOCUMENTS

| | | | | |
|---|---|---|---|---|
| 2,524,240 | A | 10/1950 | Titterton et al. | 378/106 |
| 2,534,758 | A | 12/1950 | Titterton | 378/106 |
| 3,567,939 | A * | 3/1971 | Schadler et al. | 378/112 |
| 4,213,048 | A * | 7/1980 | Quang et al. | 378/113 |
| 4,947,415 | A | 8/1990 | Collins | 378/122 |
| 6,285,740 | B1 * | 9/2001 | Seely et al. | 378/98.9 |

(Continued)

FOREIGN PATENT DOCUMENTS

| | | |
|---|---|---|
| DE | 659 016 C | 4/1938 |

(Continued)

*Primary Examiner*—Courtney Thomas
(74) *Attorney, Agent, or Firm*—Gardner, Carton & Douglas LLP

(57) ABSTRACT

An invention related to an X-ray device for the generation of brief X-ray pulses comprising an X-ray tube having a thermionic cathode and an anode and an X-ray generator having a first circuit for the generation of a high-voltage pulse which is applied to the anode for the generation of the X-ray pulse. The X-ray generator further comprising a second circuit by which a low voltage is continuously applied to the anode which pre-heats the X-ray tube and is at most sufficient for the generation of low-energy X-radiation. The first circuit can have a high-voltage power supply unit which charges a high-voltage capacitor which can be applied to the anode via a high-voltage switch. The first circuit can be a Marx generator. There may be only one power supply, which both generates the continuously low voltage and also drives the Marx generator for the generation of the high voltage. The X-ray unit can be part of an apparatus for the inspection of objects which has an imaging apparatus for the generation of an image of the object by means of the X-ray.

11 Claims, 3 Drawing Sheets

U.S. PATENT DOCUMENTS 6,329,763 B1 12/2001 Pascente ..... 315/277

FOREIGN PATENT DOCUMENTS

| | | | |
|---|---|---|---|
| DE | 25 32 300 | A1 | 1/1977 |
| DE | 32 16 733 | A1 | 12/1983 |
| EP | 1 158 842 | A1 | 11/2001 |
| GB | 649876 | A | 2/1951 |
| JP | 60-254600 | A | 12/1985 |
| WO | WO 94/23552 | A1 | 10/1994 |
| WO | WO 02/31857 | A1 | 4/2002 |

* cited by examiner

X-RAY UNIT FOR THE GENERATION OF BRIEF X-RAY PULSES AND INSPECTION DEVICE OPERATING WITH SUCH AN X-RAY UNIT

CROSS-REFERENCE TO RELATED PATENT APPLICATIONS

This patent application claims priority from patent application PCT/EP2003/013082 filed Nov. 21, 2003, which claims priority from German Patent Application Number 202 18 138.3, which was filed on Nov. 21, 2002, the entire content of which is herein incorporated by reference.

FIELD OF THE INVENTION

This invention relates to the inspection of objects, especially containers.

BACKGROUND OF THE INVENTION

It is known to use X-rays to inspect drink bottles and luggage which are moved past an imaging apparatus onto a transport device. X-ray image intensifiers or converters with a downstream CCD camera are used as imaging systems and the recorded image relayed to an evaluation system. By using a surface sensor in the X-ray image intensifier it is possible to greatly reduce both the radiation energy and also the power input of the X-ray pulse. However, due to the movement of the X-rayed objects, the contours of the images lack sharpness.

If other sensors are used, e.g. line sensors such as a plurality of photomultiplier tubes arranged in a row with the scintillator crystals, all of the energy must be made available continuously even when no object is in the beam path to be inspected. As a result, high radiation energies are released, and high electric outputs are required. Expensive screening and security measures are therefore required for the high connected loads of the equipment and radiation protection.

X-ray units for the generation of brief X-ray pulses are known from DE-C-32 16 733, U.S. Pat. No. 4,947,415 and WO 94/23552. These units serve to generate extremely brief X-ray pulses lasting a few nanoseconds. Specially developed capacitors are used to generate the high-voltage pulse, in order to be able to transmit the high-voltage energy to the anode within an extremely brief pulse duration.

An X-ray unit with an electron field emission cathode is known from WO 02/31857, with which X-ray pulses of different energies can be generated by focusing the electron beam on different anode materials.

An X-ray beam generator for the generation of X-ray pulses is known from EP-A-1 158 842, the high voltage being applied continuously to the anode and the grid voltage being controlled according to the cathode current such that during the period in which no X-ray beams are to be generated, no electrons reach the anode. The pulse duration is also controlled by means of the grid voltage. It is thereby made possible to generate a stable X-ray pulse.

BRIEF SUMMARY OF THE INVENTION

The invention is directed to an X-ray unit for the generation of X-ray pulses in the millisecond range. According to the invention this object is achieved by an X-ray unit comprising an X-ray tube with a thermionic cathode, an anode, and an X-ray generator that generates a high-voltage pulse and continuously applies low voltage to the anode of the X-ray tube.

The invention is also directed to an apparatus for inspecting objects. In one embodiment, the apparatus comprises the X-ray unit described above and an imaging apparatus for generating an image of an object with an X-ray. The X-ray unit is particularly suitable for use in an apparatus for the inspection of objects, such as containers, drink bottles, suitcases etc., transported through the apparatus at irregular intervals because the start phase for powering-up the X-ray tube is extremely brief. The start phase is essentially defined only by the discharge curve of the capacitors thus making possible contour-sharp images with relatively low radiation energy. This is an advantage over the prior art because it provides sharp images with reduced radiation.

DETAILED DESCRIPTION OF THE INVENTION

Figure 1:
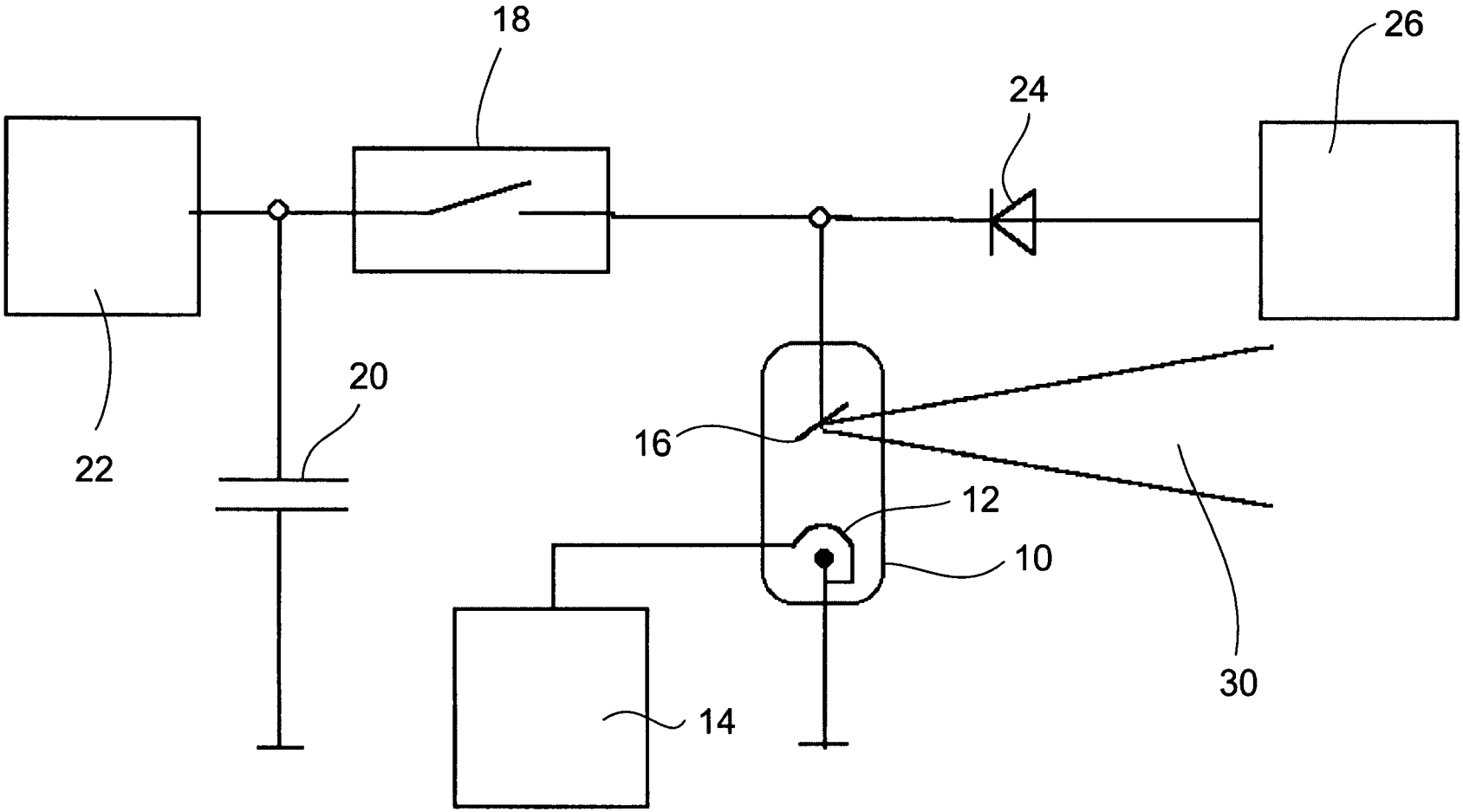
FIG. 1 is a circuit diagram of an embodiment of the X-ray device.
Figure 2:
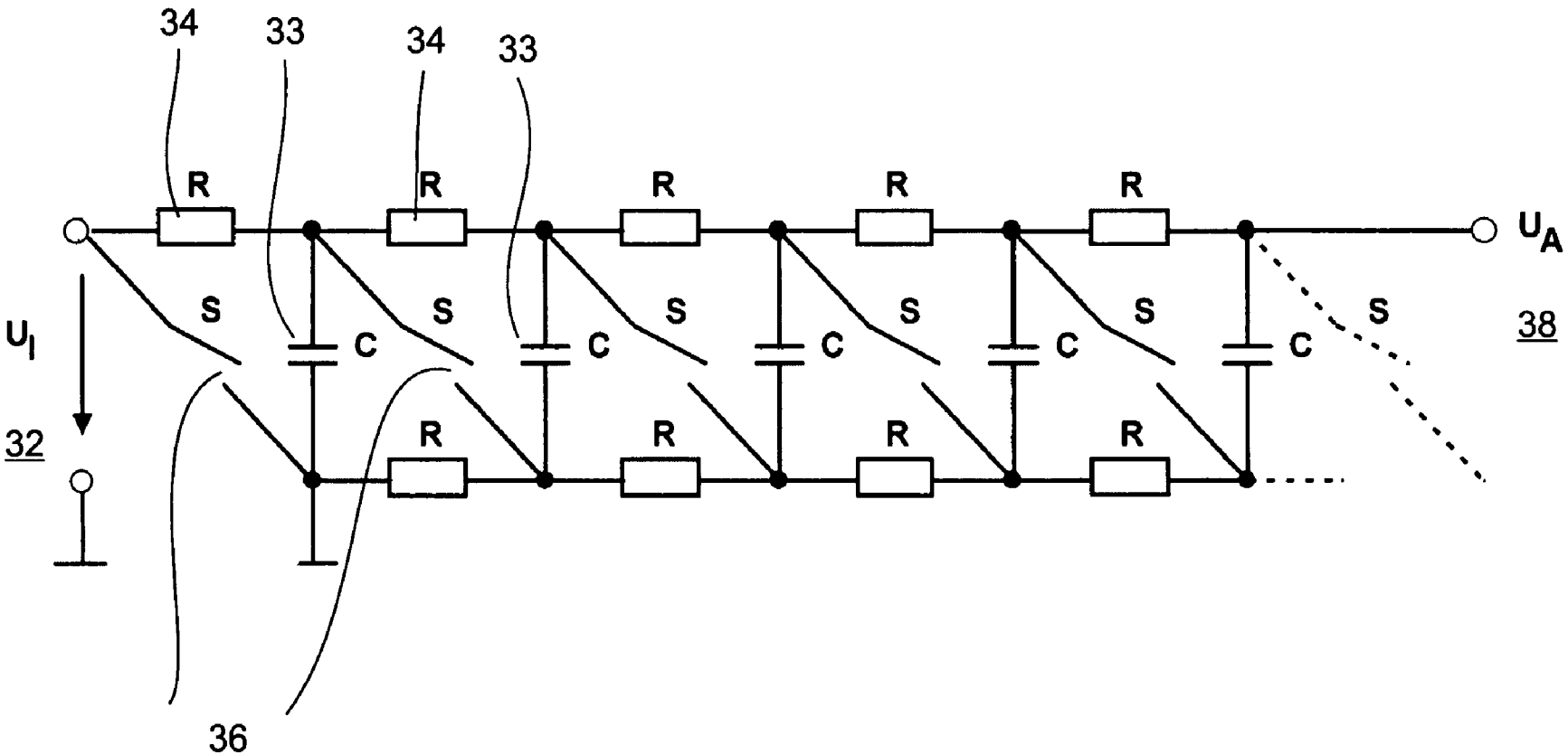
FIG. 2 is a circuit diagram of an embodiment of a Marx generator.
Figure 3:
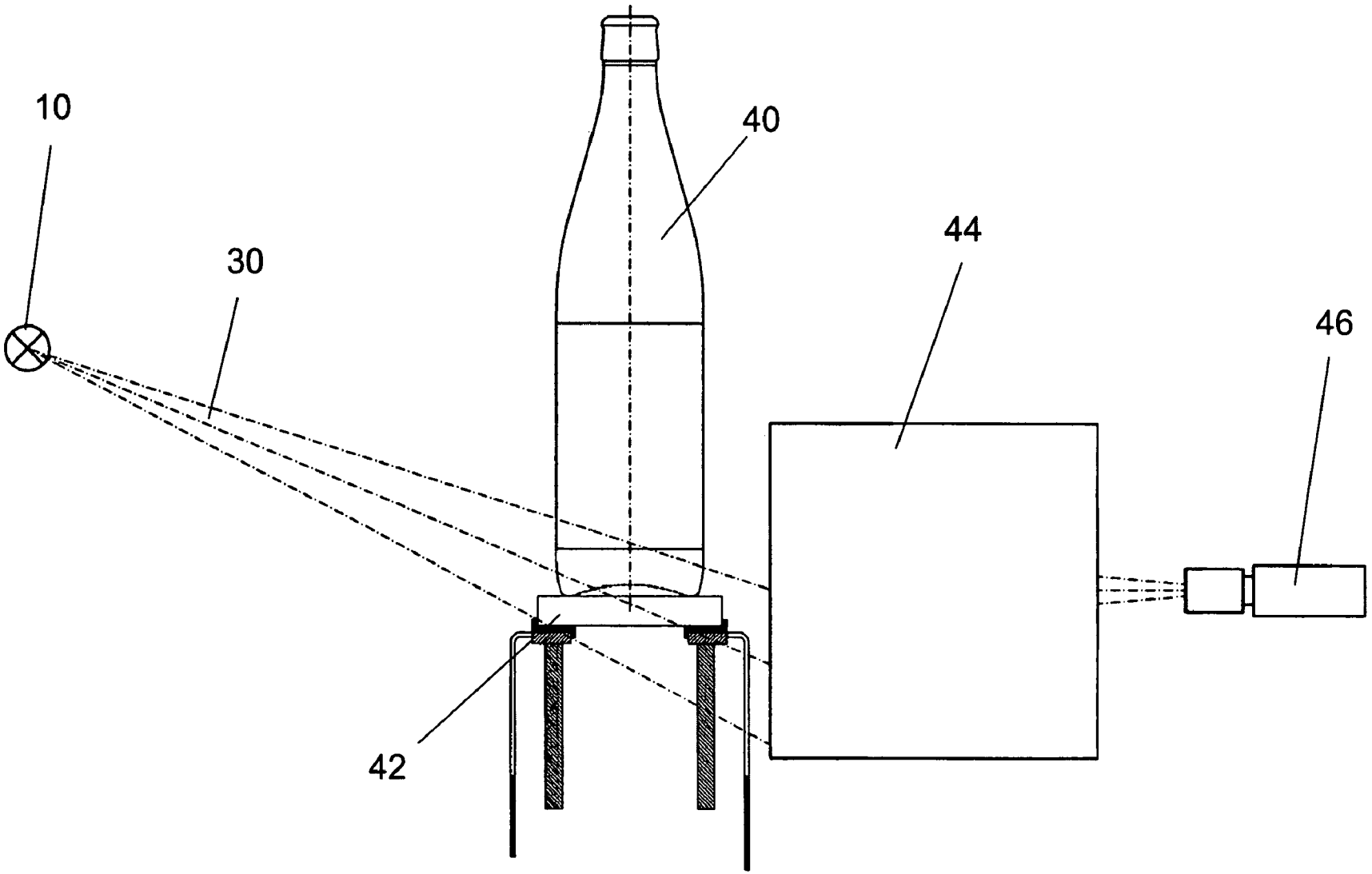
FIG. 3 is a front view of one embodiment of an apparatus according to the invention wherein the X-ray device represented in FIG. 1 is used to inspect drink bottles.

As shown in FIGS. 1–3, the invention is directed to a device for the generation of brief X-ray pulses and also to an apparatus for the inspection of objects such as containers, drink bottles, suitcases etcetera. The X-ray unit contains an X-ray tube with a thermionic cathode and an anode, and it also contains an X-ray generator. The X-ray generator has a first circuit for the generation of a high-voltage pulse which can be applied to the anode to generate the X-ray pulse.

The X-ray tube operates in simmer mode. The X-ray generator has a second circuit, a simmer power supply unit, which applies low voltage to the anode. By "low voltage" what is meant is a voltage at which at the lowest-energy X-radiation is generated that is absorbed by the glass wall of the X-ray tube. This low voltage is continuously applied to the anode, yet practically no X-radiation is generated. Nevertheless, the X-ray tube is pre-heated so that the X-ray tube can be quickly powered-up at any time and a brief X-ray pulse generated.

A protective diode protects the simmer power supply unit when the high voltage is switched on. Another possibility for the generation of the high-voltage pulse is the use of a Marx generator. The cathode is always heated with constant heating current via a heating control.

Such an X-ray unit is particularly suitable as part of an apparatus for the inspection of objects, in particular containers which are transported through the inspection apparatus at irregular intervals. Because the start phase for powering-up the X-ray tube is extremely brief and essentially is defined only by the discharge curve of the capacitors, contour-sharp images are possible with relatively low radiation energy.

The X-ray unit according to the invention is suitable in particular as an X-ray beam source in the case of the device in the utility model application DE-U-202 17 559.6 (application date: $12^{th}$ Nov. 2002, title: "Device for testing filled containers using X-rays").

Both the X-ray unit for the generation of brief X-ray pulses and the apparatus for the inspection of containers will now be described in detail with reference to the FIGS. 1–3.

In an embodiment as shown in the circuit diagram of FIG. 1, the cathode 12 of an X-ray tube 10 is connected to a heating control 14. This provides the cathode 12 with a constant heating current. Anode 16 is connected via a high-voltage switch 18 to a high-voltage capacitor 20 which is charged by a high-voltage power supply unit 22. Anode 16 is also connected to a simmer power supply unit 26 via a protective diode 24.

The high-voltage power supply unit 22 charges the high-voltage capacitor 20 to 60 kV. By closing the high-voltage switch 18 this voltage is applied to anode 16 of X-ray tube 10, whereby an X-ray 30 is generated.

The X-ray tube 10 is operated in simmer mode by a simmer power supply unit 26, the simmer power supply unit 26 producing a voltage of approximately 5 kV and continuously allowing a direct current of between approximately 1 to 10 mA to flow through the X-ray tube 10. The X-ray tube 10 is thereby pre-heated to the point where it immediately powers up and generates an X-ray 30 as soon as the high-voltage switch 18 is closed. The simmer power supply unit 26 is protected against the high voltage of the capacitor 20 by the protective diode 24.

In another embodiment, instead of the high-voltage power supply 22 and the high-voltage capacitor 20 and the high-voltage switch 18, a Marx generator can be used as shown in FIG. 2. The Marx generator is a voltage multiplier with which a pulsed high voltage can be generated. A number of n capacitors 33 which are connected in parallel by resistors 34 are charged by a voltage source 32. To trigger the high-voltage pulse, the capacitors 33 are connected in series by an electronic switch 36. Then the n-fold capacitor voltage is applied to the output 38.

If, for example, a voltage source 32 of 5 kV and 12 parallel-connected capacitors 33 are used, the generated high-voltage pulse is 60 kV. Therefore, in the present case the simmer power supply unit 26 can be used as voltage source 32.

FIG. 3 shows one embodiment of an apparatus for the inspection of containers comprised of the X-ray unit described above and an imaging apparatus for generating an image of an object with an X-ray. In this embodiment, drink bottles 40 are conveyed on a transport device 42 such as a link chain conveyor. On one side of the transport device 42 there is an X-ray tube 10. On the opposite side of the transport device 42, there is an X-ray image converter 44 behind which a CCD camera 46 is arranged. A trigger signal is generated by means of a device such as a light barrier or a capacitive sensor if a drink bottle 40 to be inspected is located between the X-ray tube 10 and the X-ray image converter 44. The high-voltage switch 18 is closed by the trigger signal, so that the X-ray tube 10 generates a pulse-like X-ray 30. After passing through the bottle 40, the X-ray 30 strikes the X-ray image converter 44 and generates there an image of the drink bottle 40. The image is recorded by the CCD camera 46 and processed in known manner by image-recognition processes in order to recognize foreign bodies, e.g. glass splinters, in the filled drink bottle 40. In order that any glass splinters are not masked by the bulge at the bottom of the drink bottle 40 the X-ray tube 10 is arranged above the plane of the transport device 42 and directs the X-ray 30 at an angle of e.g. 30° from above onto the container bottom, as is described in detail in the above-named utility model application DE-U-202 17 559.6 (title: "Device for testing filled containers using X-rays").

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

The invention claimed is:

1. An X-ray device for the generation of at least one X-ray pulse, the device comprising:

an X-ray tube having a thermionic cathode and an anode; and an X-ray generator comprising a Marx generator for the generation of at least one high-voltage pulse applied to the anode for the generation of the at least one X-ray pulse, and a simmer power supply unit by which a low voltage is continuously applied to the anode wherein the low voltage is at most sufficient for the generation of low-energy X-radiation and pre-heats the X-ray tube;

wherein the simmer power supply unit is a voltage source of the Marx generator.

2. An apparatus for the inspection of objects, the apparatus comprising:

an X-ray tube having a thermionic cathode and an anode;

an X-ray generator comprising a Marx generator for generating at least one high-voltage pulse applied to the anode for the generation of at least one X-ray pulse, and a simmer power supply unit by which a low voltage is continuously applied to the anode, wherein the low voltage pre-heats the X-ray tube and is at most sufficient for the generation of low-energy X-radiation;

an imaging apparatus for generating an image of the object by means of the at least one X-ray pulse.

3. A method of generating an X-ray pulse comprising:

providing an X-ray tube having a thermionic cathode and an anode;

preheating the X-ray tube by continuously applying a low voltage to the X-ray tube wherein the low voltage preheats the X-ray tube and is at most sufficient for the generation of low-energy X-radiation;

generating at least one high voltage pulse; and applying the at least one high voltage pulse to the anode to generate at least one X-ray pulse.

4. The method of claim 3 wherein the at least one high voltage pulse is generated by a Marx generator.

5. The method of claim 3 wherein, a first circuit generates the at least one high voltage pulse, and wherein further, the X-ray tube is preheated by a second circuit that is the voltage source of the first circuit.

6. A method of inspecting objects comprising:

providing an X-ray tube having a thermionic cathode and an anode;

preheating the X-ray tube by continuously applying a low voltage to the X-ray tube wherein the low voltage preheats the X-ray tube and is at most sufficient for the generation of low-energy X-radiation:

generating at least one high voltage pulse;

applying the at least one high voltage pulse to the anode whereby at least one X-ray pulse is generated, passing the at least one X-ray pulse through an object; and generating an image based on the at least one X-ray pulse passing thru the object.

7. The method of claim 6 wherein the at least one high voltage pulse is generated by a Marx generator.

8. The method of claim 6 wherein, a first circuit generates the at least one high voltage pulse, and wherein further, the X-ray tube is preheated by a second circuit that is the voltage source of the first circuit.

9. The method of claim 6 further comprising:

transporting the object on a substantially horizontal plane of transport; and moving the object through the at least one X-ray pulse wherein the X-ray pulse has a predetermined direction.

10. The method of claim 6, wherein the object is one of a plurality of containers being transported individually in succession in a row on a substantially horizontal plane of transport.

11. The method of claim 6, wherein the at least one X-ray pulse passing through the object, strikes an X-ray image converter and generates an image therein that is recorded by a digital camera.

* * * * *